United States Patent [19]

Bagnall et al.

[11] 4,306,231

[45] Dec. 15, 1981

[54] YARN DETECTORS

[75] Inventors: Arthur F. Bagnall, Manchester; Edward C. Lear, Turton, near Bolton, both of England

[73] Assignee: Spencer Wright Industries, Inc., Chattanooga, Tenn.

[21] Appl. No.: 137,560

[22] Filed: Apr. 4, 1980

[30] Foreign Application Priority Data

Apr. 10, 1979 [GB] United Kingdom ..... 12590/79
May 18, 1979 [GB] United Kingdom ..... 17451/79

[51] Int. Cl.[3] ..... G08B 19/00

[52] U.S. Cl. ..... 340/668; 340/677; 73/862.48; 112/278

[58] Field of Search ..... 112/278, 273, 79 R, 112/79 A; 340/668, 677; 66/163; 242/49, 148, 153; 200/61.13, 61.18; 73/144

[56] References Cited

U.S. PATENT DOCUMENTS

| | | | |
|---|---|---|---|
| 2,695,519 | 11/1954 | Lodge | 242/148 X |
| 2,767,576 | 10/1956 | Seney | 73/144 |
| 3,343,008 | 9/1967 | Bancroft | 73/144 X |
| 3,510,862 | 5/1970 | Bell et al. | 340/677 |
| 3,521,265 | 7/1970 | Bancroft | 340/668 |
| 3,783,811 | 1/1974 | Schmedding | 112/278 |
| 3,850,122 | 11/1974 | Daeli | 112/278 |
| 3,851,502 | 12/1974 | Hopkins | 66/163 |
| 4,078,505 | 3/1978 | Fitton et al. | 112/278 X |

*Primary Examiner*—Peter P. Nerbun
*Attorney, Agent, or Firm*—Alan Ruderman

[57] ABSTRACT

A yarn tension detector having a cage-like form pivotably moveable between predetermined limits about the pivot point and under the control of the tension of a moving yarn. The detector includes a pair of spaced abutment members in an electrical circuit with a lamp. The cage-like member makes a circuit whenever it engages one or the other of the abutments to thereby cause the bulb to light. The member also includes oppositely directed guide formations about which a yarn is trained and as the yarn is fed from a creel to, for example, a tufting machine the tension in the yarn as it moves through the guide formations pivots the member. One of the guide formations progressively opens when the yarn tension is in excess of a predetermined high tension to release the yarn from the detector after it has indicated the yarn tension fault. One detector for each yarn cone in a creel may be connected into a circuit having an indicator at the end of a creel alley to indicate when one of the detectors in the alley has a fault and all detectors may be connected to a display device to identify a specific detector.

10 Claims, 11 Drawing Figures

YARN DETECTORS

BACKGROUND OF THE INVENTION

This invention relates to multi-yarn machinery for producing fabric, such as tufting machines, and more particularly to the detecting of a deviation from a norm in the tension of a yarn end and to its identification.

Tufting machines such as those used to produce tufted carpet and like materials may employ upwardly of one thousand needles mounted for vertical reciprocation, each of which needles carries a separate individual yarn into cooperative relationship with a looper to produce the tufted pile. Due to various conditions such as creel snarl-ups, that is yarn snarling as it pulls off the creel cones, excessive tension in one or of a few yarns may occur. Moreover, the reverse condition, that being no tension or a broken yarn may likewise occur. In the production of tufted fabrics the high rate of output of these machines is such that a substantial length of material containing a fault due, for example, to a broken or tight end may be produced before the fault is evident with consequential loss due to the defective fabric. This problem has been recognized in the prior art and various prior art detecting devices are known. Examples of such detectors are illustrated in U.S. Pat. Nos. 3,221,682; 3,221,683; 3,764,773; 3,994,245 and 4,078,505. The prior art detectors however are directed toward either excessive tension or zero tension, i.e. broken yarn, and do not detect deviations on both sides of a norm of the tension in the yarn. Moreover, the known detectors do not provide an immediate readily visible indication of the fault.

SUMMARY OF THE INVENTION

It is a primary object of the present invention to provide a detector sensitive to yarn tension and which is capable of providing an indication of any substantial deviation from a norm of the tension in the yarn.

It is another object of the present invention to provide a yarn tension detector capable of sensing a predetermined change in the tensioning of a yarn engaged therewith.

It is a further object of the present invention to provide a yarn sensing detector for a tufting machine which will indicate which of the multiplicity of yarns has a predetermined deviation in tension from a predetermined value, each detector arranged to produce an electrical output in response to detection thereby of the predetermined change in the tension of a yarn engaged therewith.

According to the present invention there is provided a yarn tension detector comprising a displaceable member moveable between predetermined limits at either side of a datum under the control of the tension of a moving yarn engaged therewith and according to such tension, the member including laterally spaced, oppositely directed guide formations thereon about which a yarn is trained and being adapted and arranged so as to cause the member to assume a respective one of the limits in conditions of high or low tension respectively.

According to a preferred feature, the displaceable member moves to the predetermined limit corresponding to the condition of high tension against a resilient restraint.

According to a further preferred feature, one of the oppositely directed guide formations is adapted progressively to be opened by yarn tension in excess of the high tension, thereby to release the yarn from the yarn tension detector.

According to a further preferred feature, the displaceable member is mounted for pivotable movement between the predetermined limits.

According to a further preferred feature, the displaceable member is cooperable with indicator means sensitive to the position of the displaceable member and adapted to provide a sensible indication of movement of the member to one or the other of the predetermined limits.

According to a still further preferred feature, the displaceable member is cooperable with means to produce an electrical output in response to movement of the displaceable member to one or the other of the predetermined limits, and an assembly of such detectors is connected to a remote display system arranged to be actuated by any of the electrical outputs to give a remote indication of the location of the detector producing output, so that rapid identification of the location of a yarn tension fault can be facilitated. The remote display system may provide complete information with regard to the identity of the location and/or it may provide only partial information which is required to be supplemented by examination of certain ones of the detectors to enable a specific fault-indicating detector to be identified.

BRIEF DESCRIPTION OF THE DRAWINGS

The particular features and advantages of the invention as well as other objects will become apparent from the following description, which is by way of example only, taken in connection with the accompanying drawings, in which.

DESCRIPTION OF THE PREFERRED EMBODIMENT

Figure 1:
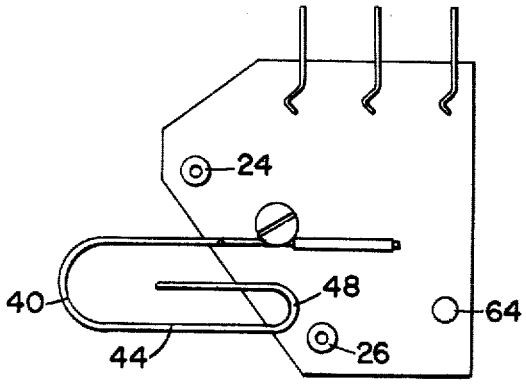
FIG. 1 is a front elevational perspective view of a yarn tension detector constructed in accordance with the principles of the present invention.

Referring now to the drawings a yarn tension detector 10 constructed in accordance with the principles of the present invention comprises a mounting board or support 12 upon which a displaceable member 14 is mounted for pivotal motion about a remote axis 16 under the control of the tension in a yarn 18 engaged with laterally spaced, oppositely directed guide formations thereon and generally indicated at 20 and 22.

Figure 2:
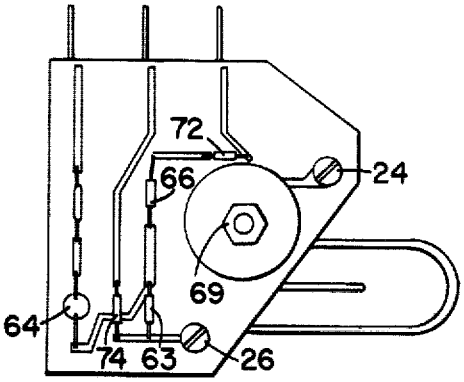
FIG. 2 is a rear elevational view of the detector of FIG. 1.

The displaceable member 14 is moveable between limits determined by spaced abutments 24,26 mounted on the board 12 and lying in the path of movement of the displaceable member. The abutments 24,26 are metallic and comprise contacts in an electrical circuit sensitive to the position of the displaceable member. As illustrated in FIG. 2 illustrating the rear of the mounting board 12, the abutment members 24,26 are electrically connected in a circuit having the electrical leads and the circuit elements mounted on the rear of the mounting board, a typical circuit being shown in FIG. 10, hereafter described in further detail.

Figure 3:
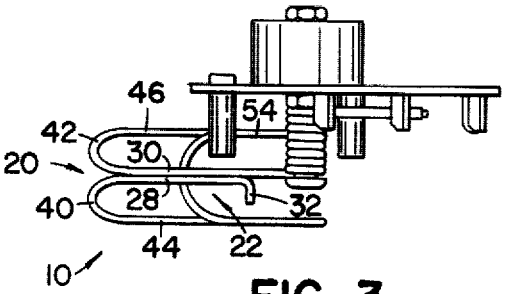
FIG. 3 is a top plan view of the detector.
Figure 4:
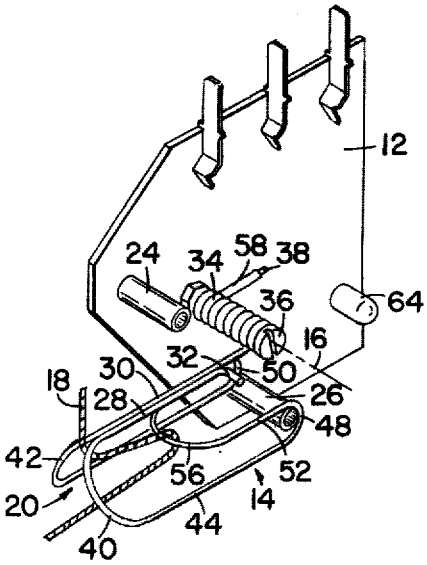
FIG. 4 is a perspective view of the detector threaded with yarn and illustrating a position corresponding to a normal yarn feed.

The displaceable member 14 is fabricated from a continuous length of wire bent into a cage-like form. As best illustrated in FIG. 3 the two ends 28,30 of the wire lie in parallel side-by-side disposition longitudinally of the top of the member, the end 28 being shortened and bent through substantially 90° to lie in the plane of the top of the member to provide a shelf-threading device 32, the other end 30 extending beyond the rear end of such top and being coiled to define a support spring 34 for mounting the displaceable member 14 aout a stud 36 secured to the board 12 co-axially with the remote axis 16. The remote end of the wire which forms the coil spring 34 defines an outwardly extending tail 38 for a purpose hereafter to be made apparent.

At the forward end of the displaceable member 14 the parallel side-by-side ends 28,30 of the wire diverge when viewed in plan to form a throat which defines the first guide formation 20. The diverging wire portions lie in the plane of the top of the member and are bent downwardly at 40,42 through substantially 90° to follow the front edges of a notional or imaginary substantially rectangular cage and then through a further 90° to follow the bottom edges 44,46 of the cage. At the rearward end of the displaceable member, those wire portions which follow the bottom edges 44,46 of the notional rectangular cage are bent upwardly at 48,50 along a line of the related edges of the cage and then are bent inwardly at 52,54 through approximately 90° to lie in a common plane parallel to the top and bottom faces 28,30 and 44,46 respectively of the cage and approximately mid-way between the top and bottom faces, the wire portions converging and meeting in an arcuate form 56 the interior of which defines the second guide formation 22.

The outwardly extending tail 38 has an electrically insulating sleeve 58 thereon, and is of such length and disposition as to be engageable with abutment 26 prior to engagement of the displaceable member 14 with abutment 24, thereby to provide a restraint to movement of the displaceable member into engagement with abutment 24. Thus, additional force must be placed on the displaceable member 14 to engage the abutment 24 after the sleeve 58 has engaged the abutment 26, the total of the force required to engage the abutment 24 being a predetermined excessive tension on the yarn 18.

Figure 9:
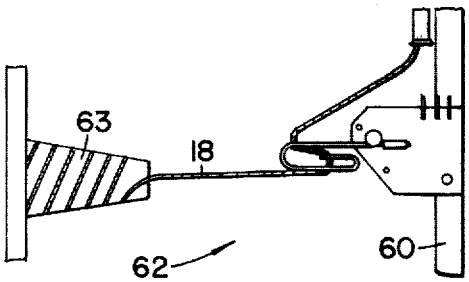
FIG. 9 is a fragmentary elevational view of a yarn creel illustrating a detector in operative position with a yarn cone.

The detector may be secured to an upstanding frame member 60 of a creel generally indicated in FIG. 9 at 62 and disposed so that in threading up the detector, a generally vertically disposed yarn 18 from a yarn cone 63 is offered up to the rearward end of the member 14, and is passed between the adjacent ends of the wire, to the throat formed by the diverging wire portions, the engagement with and the separation of such parallel ends against the inherent resilience of the wire being facilitated by the laterally extending self-threading device, the yarn thereby engaging the first and second guide formations 20,22.

Figure 5:
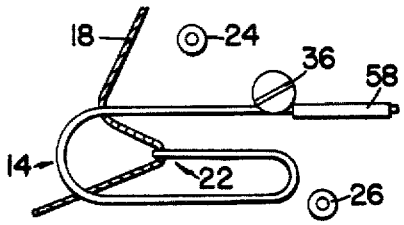
FIGS. 5 through 8 are diagrammatic views illustrating the operation of the detector in sensing normal, high and low tensions.
Figure 6:
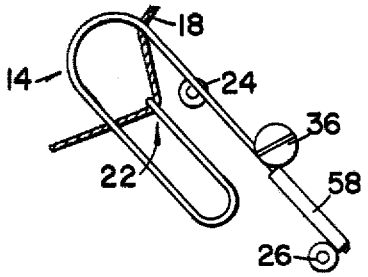
Figure 7:
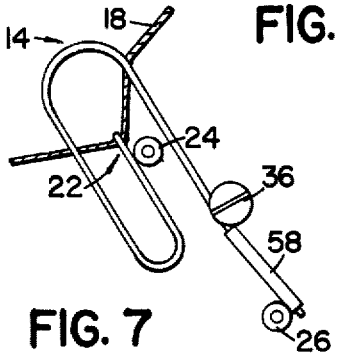
Figure 8:
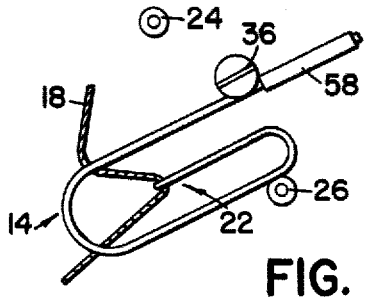

Under the conditions of normal yarn tension, the member 14 oscillates between the angular disposition shown generally in FIGS. 5 and 6, engagement of the tail 38 with the related abutment 26 maintaining the displaceable member out of contact with abutment 24. When the tension of the yarn is in excess of the normal yarn tension, the member 14 is pivoted upwardly beyond the position shown in FIG. 6 against the restraint of the spring 34 of which the tail 38 forms an extension and into contact with abutment member 24 as illustrated in FIG. 7, thereby to complete an electrical indicator circuit of which the displaceable member and the abutment member 24 form a part. As will be appreciated, in the event of a yarn tension sufficient to overcome the resistance to displacement of the adjacent parallel ends 28,30 of the wire, the yarn will automatically be withdrawn from the detector, but the restraint derived from the tail extension to the spring is so selected as to insure contact between the displaceable member and the abutment member 24 before withdrawal of the yarn from the guide formation 20. In the event of a slack or broken yarn the displaceable member pivots downwardly under gravity into engagement with the lower abutment member 26 as illustrated in FIG. 8, thereby to complete an electrical indicator circuit of which the displaceable member and abutment member 26 form a part.

Figure 10:
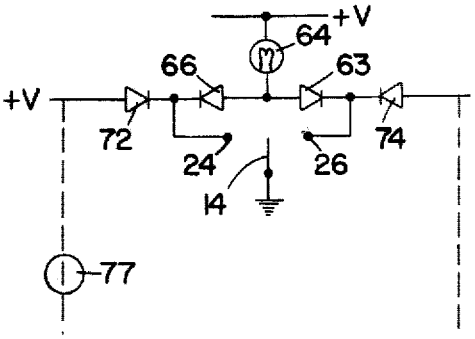
FIG. 10 is a circuit diagram of a typical indicator circuit for use in conjunction with the detector.

Although it may be found sufficient, in some circumstances, to rely upon a visual indication of high or low yarn tension simply by reference to the position of the tail extension to the spring, the nonconducting sleeve 58 applied to the tail being brightly colored to improve its visability, in the embodiment illustrated the displaceable member 14 and abutment members 24,26 are electrically conducting and form part of an electrical indicator circuit operable to provide an indication of a high or low yarn tension. A typical circuit is illustrated in FIG. 10, such circuit allowing of the illumination of a single bulb in conditions of high or low yarn tension. A bulb 64 is connected in circuit with a pair of diodes 66,68 and the abutments 24,28. The displaceable member 14 is connected to ground through the stud shaft 36 and its connection by nut 69 to the frame of the creel so that when the member 14 engages the metallical abutment 24 voltage flows through the bulb 64 and the diode 66; similarly when the displaceable member contacts the metallic abutment 26 voltage flows through the bulb and the diode 68. In either case the bulb lights to give a visible indication of a fault.

Figure 11:
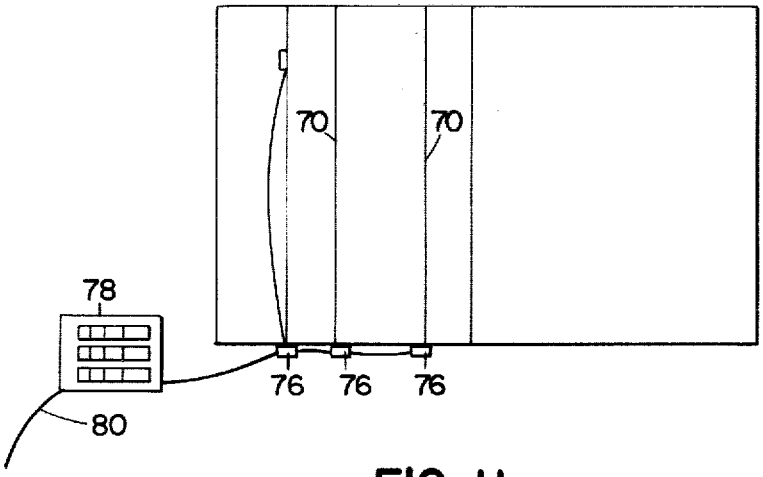
FIG. 11 is a diagrammatic representation of a creel provided with an assembly of yarn tension detectors.

As illustrated in FIG. 11 the detectors may be arranged in a plurality of creel alleys or lines 70 with each detector connected in auxiliary circuits in each creel alley with the interposition of diodes 72,74. Each detector in a creel alley is electrically connected to an indicator 76 at the end of the alley to be actuated to effect illumination of a signal lamp 77 or the like incorporated in the indicator 76. To this end the diodes 72,74 of each detector in a creel alley may be connected across a common voltage source in circuit with the signal lamp. With this arrangement, in the event that a fault occurs, the location of the fault can be found quickly and easily by noting the actuated alley indicator 76 and then examining the individual detectors 10 of that alley.

The individual detectors may also be connected utilizing multiplexing techniques, to a common display unit 78 located alongside the creel. Such units 78 may incorporate microprocessor control processing circuitry and also a bank of cathode ray tube digital display devices. In the event that a fault occurs, data is fed from the pertaining detector to the unit 78 and a numerical digital display is produced which specifically identifies the location of the fault. The unit 76 has a data output 80 thereto and a code signal produced at such output corresponding to the numerical display produced on the unit 78. Such code signal can be fed to a remote central processing unit for utilization for information purposes. In this way detailed information concerning yarn tension faults can be collected in a particularly simple and convenient manner.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. A yarn tension detector for detecting and indicating a deviation from a norm of the tension of a moving yarn fed between a yarn supply and a yarn employing device, said detector comprising an elongated wire bent into a form having a pair of oppositely directed yarn engaging guide formations, the yarn being directed from the yarn supply to and trained about a first of said guide formations to the second of said guide formations and directed from the second of said guide formations to the yarn employing device, a support, first and second spaced abutment members on said support, one of said abutment members corresponding to a predetermined condition of high yarn tension and the other of said abutment members corresponding to a predetermined condition of low yarn tension, means spaced from said guide formations for mounting said wire form intermediate said abutment members for pivotable movement between limits defined by said abutment members, and means for indicating the position of said wire form.

2. A yarn tension detector as recited in claim 1, wherein said abutment members comprise electrical contacts, an electrically actuated light emitter, means electrically connecting each of said abutment members with said light emitter, a source of electrical potential, and means connecting said source of electrical potential between said wire form and said light emitter, whereby said light emitter illuminates upon contact of said wire form with either of said abutment members.

3. A yarn tension detector as recited in claim 1, wherein said means for mounting said wire form includes resilient means, said resilient means acting to restrain said wire form from contacting said abutment member corresponding to said predetermined condition of high yarn tension until the occurrence of said predetermined condition of high yarn tension.

4. A yarn tension detector as recited in claim 1, wherein said second yarn engaging guide formation comprises a pair of substantially parallel side-by-side limbs of said wire formation having portions diverging one from the other to define a throat therebetween, said yarn normally lying in said throat between said limbs and acting to separate said limbs, whereby said limbs progressively separate when the yarn is tensed in excess of said predetermined condition of high yarn tension.

5. A yarn tension detector as recited in claim 2, wherein said light emitter and said connecting means are carried by said support.

6. A yarn tension detector as recited in claim 1, wherein said means for indicating the position of said wire form includes a tail extending from said wire form.

7. A yarn tension detector as recited in claim 1, wherein said wire form comprises a continuous length of wire bent into cage-like form, said wire having two limbs lying in parallel side-by-side disposition, one of said limbs being shortened relatively to said other end and disposed at an angle thereto to form a self-threading means, the other of said limbs being disposed in a coil, said means for mounting said wire form comprising means for supporting said coil for pivotable movement about an axis substantially normal to said support.

8. A yarn tension detector as recited in claim 2, wherein said second yarn engaging guide formation comprises a pair of substantially parallel side-by-side limbs of said wire formation having portions diverging one from the other to define a throat therebetween, said yarn normally lying in said throat between said limbs and acting to separate said limbs, whereby said limbs progressively separate when the yarn is tensed in excess of said predetermined condition of high yarn tension.

9. A yarn tension detector as recited in claim 7, wherein said two limbs have portions diverging one from the other to define a throat therebetween, said yarn normally lying in said throat between said limbs and acting to separate said limbs, whereby said limbs progressively separate when the yarn is tensed in excess of said predetermined condition of high yarn tension.

10. A yarn detector as recited in claim 2 including means for mounting said support on a yarn creel, and means electrically connecting said detector with a remote indicator for indicating at the remote indicator when the light emitter is illuminated.

* * * * *